US008074704B2

(12) United States Patent
Blackburn et al.

(10) Patent No.: US 8,074,704 B2
(45) Date of Patent: Dec. 13, 2011

(54) METHOD AND APPARATUS FOR SEMI-CONTINUOUS CASTING OF HOLLOW INGOTS AND PRODUCTS RESULTING THEREFROM

(75) Inventors: Alan Blackburn, Reading, PA (US); Richard Roth, Birdsboro, PA (US); Andrew Purse, Downingtown, PA (US); David May, Robesonia, PA (US)

(73) Assignee: Titanium Metals Corporation, Dallas, TX (US)

( * ) Notice: Subject to any disclaimer, the term of this patent is extended or adjusted under 35 U.S.C. 154(b) by 0 days.

(21) Appl. No.: 12/730,970

(22) Filed: Mar. 24, 2010

(65) Prior Publication Data

US 2010/0247946 A1 Sep. 30, 2010

Related U.S. Application Data

(60) Provisional application No. 61/164,008, filed on Mar. 27, 2009.

(51) Int. Cl.

| | |
|---|---|
| ***B22D 11/00*** | (2006.01) |
| ***B22D 27/04*** | (2006.01) |
| ***B22D 23/06*** | (2006.01) |

(52) U.S. Cl. ..... 164/464; 164/465; 164/421; 164/494; 164/250.1; 164/512; 164/485; 164/443

(58) Field of Classification Search ..... 164/464, 164/465, 421, 494, 495, 497, 250.1, 512, 164/515, 443, 485, 348

See application file for complete search history.

(56) References Cited

U.S. PATENT DOCUMENTS

| | | | | |
|---|---|---|---|---|
| 2,473,221 | A * | 6/1949 | Rossi | 164/465 |
| 3,658,116 | A | 4/1972 | Hunt | |
| 3,683,999 | A | 8/1972 | Kocks | |
| 4,204,884 | A | 5/1980 | Berg et al. | |
| 4,205,716 | A | 6/1980 | Nakahira et al. | |
| 4,278,124 | A | 7/1981 | Aso et al. | |
| 4,456,054 | A | 6/1984 | Henders | |

(Continued)

FOREIGN PATENT DOCUMENTS

FR 2 691 655 A1 * 12/1993

(Continued)

OTHER PUBLICATIONS

International Search Report which was mailed Oct. 26, 2010, and received in corresponding international patent application No. PCT/US2010/028493.

(Continued)

*Primary Examiner* — Kevin P Kerns

(74) *Attorney, Agent, or Firm* — Locke Lord LLP

(57) ABSTRACT

Methods and associated apparatus for semi-continuous casting of hollow ingots are described. In one embodiment a method for the semi-continuous casting of a metallic hollow ingot is provided. The method includes providing a mold that includes a mold center having an inner pipe and an outer pipe arranged to form an annular space for a cooling media and an outer mold, circulating a cooling media in the annular space, feeding a source material to the mold, heating the source material to produce a molten material, moving the mold center progressively downward relative to the outer mold, and solidifying the molten material to form a hollow ingot. Embodiments relating to an apparatus for semi-continuous casting of hollow ingots, and products resulting from the semi-continuous casting of hollow ingots are also described.

17 Claims, 10 Drawing Sheets

U.S. PATENT DOCUMENTS

| | | | |
|---|---|---|---|
| 4,558,729 | A | 12/1985 | Hunt |
| 4,583,580 | A | 4/1986 | Hunt |
| 4,616,363 | A | 10/1986 | Harker et al. |
| 4,641,704 | A | 2/1987 | Lowe |
| 4,681,787 | A | 7/1987 | Hunt |
| 4,690,875 | A | 9/1987 | Hunt |
| 4,719,959 | A | 1/1988 | Nawata et al. |
| 4,729,422 | A | 3/1988 | Ernst et al. |
| 4,750,542 | A | 6/1988 | Harker et al. |
| 4,759,399 | A | 7/1988 | Saito et al. |
| 4,823,358 | A | 4/1989 | Aguirre et al. |
| 4,838,340 | A | 6/1989 | Entrekin et al. |
| 4,932,635 | A | 6/1990 | Harker |
| 4,936,375 | A | 6/1990 | Harker |
| 4,961,776 | A | 10/1990 | Harker |
| 5,052,469 | A | 10/1991 | Yanagimoto et al. |
| 5,084,090 | A | 1/1992 | Harker |
| 5,100,463 | A | 3/1992 | Harker |
| 5,171,357 | A | 12/1992 | Aguirre et al. |
| 5,222,547 | A | 6/1993 | Harker |
| 5,291,940 | A | 3/1994 | Borofka et al. |
| 5,922,273 | A | 7/1999 | Knecht et al. |

FOREIGN PATENT DOCUMENTS

| | | | |
|---|---|---|---|
| GB | 643 122 | A | 9/1950 |
| JP | 56 134048 | A | 10/1981 |
| JP | 58023535 | A | 2/1983 |
| JP | 58125342 | A | 7/1983 |
| JP | 63 230260 | A | 9/1988 |
| JP | 2001 287004 | A | 10/2001 |
| JP | 2002192332 | A | 7/2002 |
| JP | 2008093695 | A | 4/2008 |
| WO | WO 03/033191 | A2 | 4/2003 |

OTHER PUBLICATIONS

Written Opinion of the International Searching Authority which was mailed Oct. 26, 2010, and received for corresponding international patent application No. PCT/US2010/028493.

* cited by examiner

METHOD AND APPARATUS FOR SEMI-CONTINUOUS CASTING OF HOLLOW INGOTS AND PRODUCTS RESULTING THEREFROM

CROSS-REFERENCE TO RELATED APPLICATIONS

This application claims priority under 35 U.S.C. §119(e) to U.S. Provisional Patent Application No. 61/164,008 which was filed on Mar. 27, 2009, the entirety of which is incorporated by reference as if fully set forth in this specification.

BACKGROUND OF THE INVENTION

I. Field of the Invention

This invention relates generally to the casting of hollow ingots such as for use in the production of large diameter casings or pipes. More particularly, the disclosed invention relates to a method and apparatus for the semi-continuous casting of metallic hollow ingots and products resulting therefrom.

II. Background of the Related Art

Conventionally, the production of large diameter casings or pipes or rolled rings typically required the initial manufacture of a large diameter ingot followed by forging to produce a smaller diameter billet. The billet is then pierced to create a tubular preform and the tubular perform is then extruded to form the casing or pipe or rolled to form a ring. However, if it were possible to directly cast the tubular preform, significant downstream processing time and expense could be avoided.

Several attempts have been made to cast high-quality, large diameter hollow ingots. One approach involves inserting a water-cooled stationary mandrel into a molten pool. Once a sufficient amount of molten metal solidified onto the surface of the mandrel, the mandrel was withdrawn from the pool. After the solidified ingot was removed from the mandrel, the mandrel itself could be reintroduced into the molten pool and the process repeated.

Another attempt involves casting molten metal into a mold comprising a stationary core encapsulated by a crucible to form an annular space into which molten metal may be poured and allowed to solidify as described, for example, in U.S. Pat. No. 4,278,124 to Aso et al. (hereinafter "Aso"). In some embodiments, the interior of the core in Aso is cooled by forced induction, thereby providing control over the cooling rate at the interior wall of the cast hollow ingot.

Still another attempt involves adding a fixed amount of molten metal to a casting vessel. The vessel is then rotated and centrifugal forces drive the metal to the outer walls of the vessel. As the metal solidifies, a layer of the desired metal forms on the walls of the vessel, thereby producing a hollow ingot.

In yet another attempt, molten metal was introduced into an annular space formed by a stationary outer mold and stationary mandrel to facilitate continuous casting in a horizontal manner, as described in more detail is U.S. Pat. No. 4,456,054 to Henders.

However, all of the aforementioned attempts suffer from a number of problems including, but not limited to: the production of out-of-center internal holes, frequent breakouts at the inner mold surface, inconsistent dimensions, long cooling times, and slow casting rates.

Accordingly, there exists a need in the art for a more cost-effective technique for producing hollow ingots which is both sufficiently controllable and repeatable to be utilized as a commercial manufacturing process.

SUMMARY OF THE INVENTION

In view of the above-described problems, needs, and goals, the present invention provides techniques for semi-continuous casting of hollow ingots.

In one embodiment a method for semi-continuous casting of metallic hollow ingots is provided. The method includes providing a mold comprising a mold center having an inner pipe and an outer pipe arranged to form an annular space for a cooling media and an outer mold, circulating a cooling media in the annular space, feeding source material into the mold cavity formed between the mold center and outer mold, melting the source material, moving the mold center progressively downward relative to the outer mold, and solidifying the source material to form a metallic hollow ingot.

In some embodiments the mold center is moved progressively downward using a puller. Further, the cooling media can be provided at substantially the base of the mold, and the cooling media can flow up through the inner pipe and down through the annular space. The cooling media can be water, but is not so limited. The mold center can be locked in place using a puller.

In some embodiments the source material is melted using one or more electron beam guns. In alternative embodiments the source material may be melted using electroslag remelting, plasma arc melting, or by using a plasma torch. The source material is preferably a metallic material which includes, but is not limited to titanium, zirconium, niobium, tantalum, hafnium, nickel, and alloys thereof. The source material can be fed at substantially the top of the mold.

In alternate embodiments the outer pipe can be constructed of steel, copper, or a ceramic material. The outer pipe can remain with the ingot after casting until further processing. The method can further include providing a receiver which holds the mold center to prevent lateral movement of the mold center during casting.

In another embodiment an apparatus for semi-continuous casting of hollow ingots is provided. The apparatus includes a mold center having an inner pipe and an outer pipe arranged to form an annular space for a cooling media, an outer mold, and a puller for moving the mold center downward.

In some embodiments, the outer pipe is consumable and can remain with the cast hollow ingot until further processing. The puller can have a hole arranged to receive the mold center. The puller can lock the mold center in place. The apparatus can further include one or more electron beam guns, an electroslag remelting apparatus, a plasma arc apparatus, or one or more plasma torches. The apparatus can further include a receiver located above the mold center and arranged to prevent lateral movement of the mold center during casting.

In yet another embodiment, the present invention provides a metallic hollow ingot product. The metallic hollow ingot product comprises a metallic hollow ingot and a pipe intimately connected to the metallic hollow ingot at the inner surface of the metallic hollow ingot. The metallic hollow ingot can be a metallic material such as titanium, zirconium, niobium, tantalum, hafnium, nickel, and alloys thereof. The pipe can be steel, copper, or a ceramic, but is not so limited.

The accompanying drawings, which are incorporated and constitute part of this disclosure, illustrate exemplary embodiments of the disclosed invention and serve to explain the principles of the disclosed invention.

Figure 1:
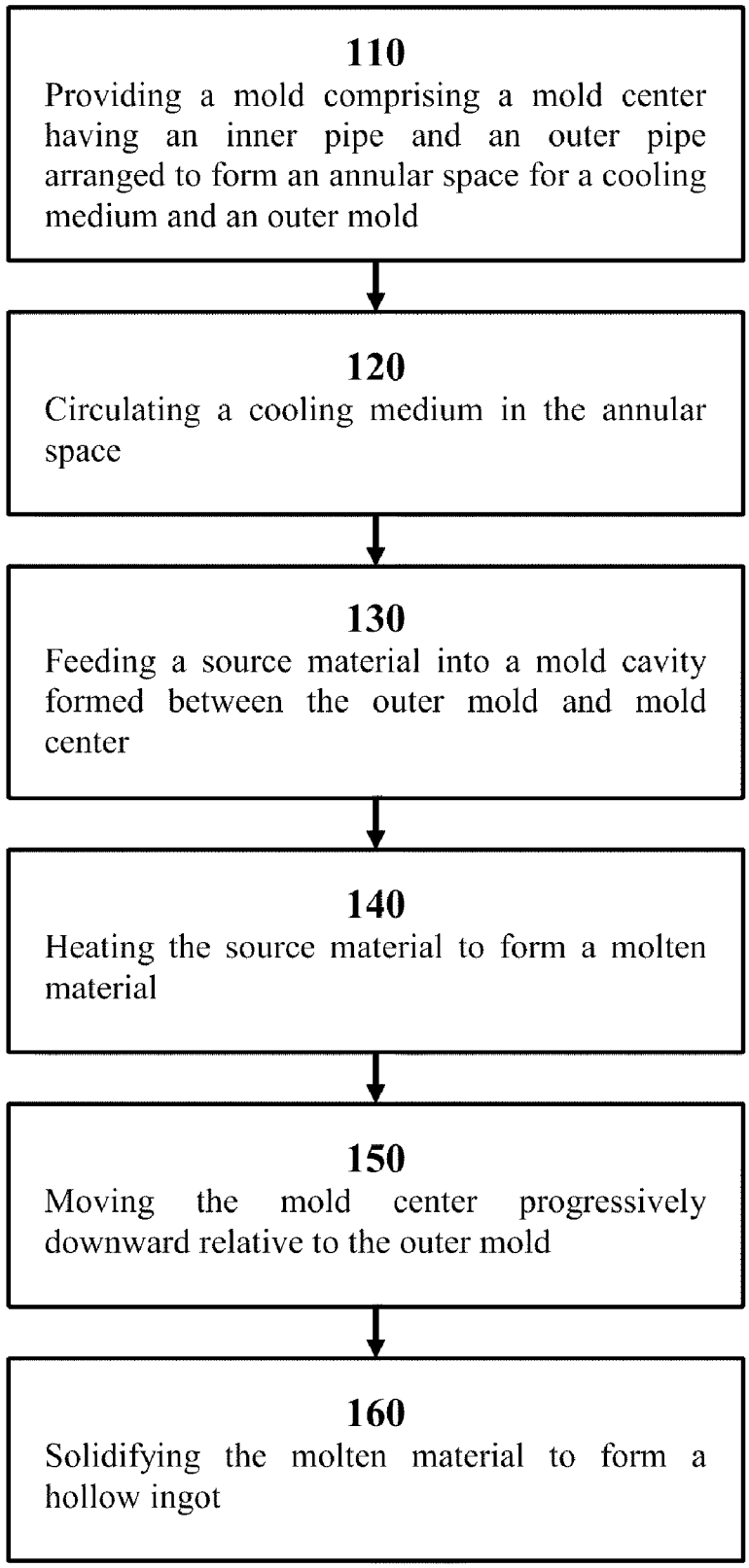
FIG. 1 is a flowchart illustrating a method for semi-continuous casting of hollow ingots in accordance with an embodiment of the present invention.

Throughout the drawings, the same reference numerals and characters, unless otherwise stated, are used to denote like features, elements, components or portions of the illustrated embodiments. Moreover, while the disclosed invention will now be described in detail with reference to the figures, it is done so in connection with the illustrative embodiments.

DETAILED DESCRIPTION OF THE INVENTION

The present invention provides apparatus and methods for the semi-continuous casting of hollow ingots that increases the casting rate and decreases the cost and time for downstream processing. The disclosed apparatus and method allow for the repeatability of results such that hollow ingots produced in accordance with the disclosed invention achieve consistent dimensions and desired surface quality.

FIG. 1 illustrates an exemplary method for semi-continuous casting of a hollow ingot in accordance with the disclosed invention. As shown in FIG. 1, the process begins with providing a mold in step 110. The mold has a mold center and an outer mold with a mold cavity formed therebetween. The mold center is comprised of an inner pipe and an outer pipe arranged to form an annular space for a cooling medium.

Figure 2A:
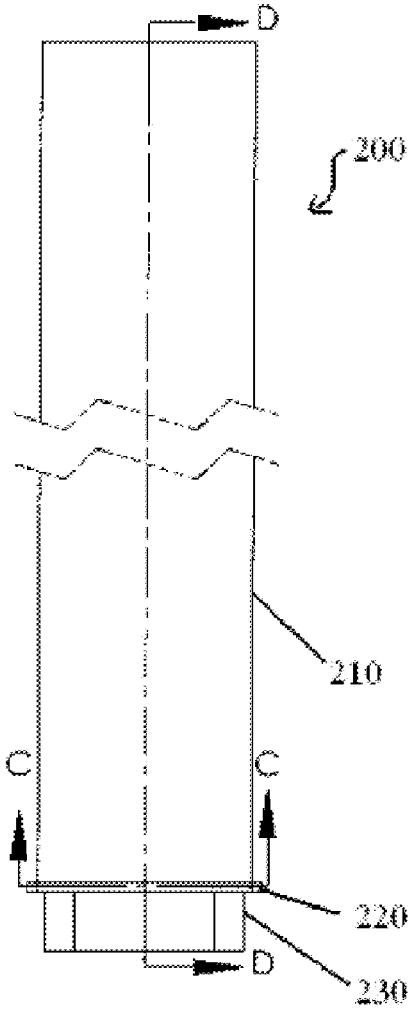
FIG. 2A is a side view of the outer pipe of the mold center in accordance with an embodiment of the present invention.
Figure 2B:
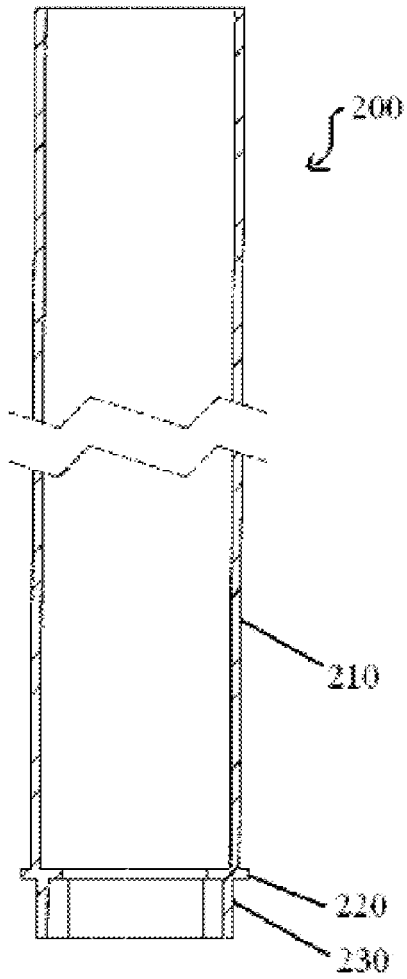
FIG. 2B is a cross-sectional view obtained along section D-D of the outer pipe shown in FIG. 2A in accordance with an embodiment of the present invention.
Figure 2C:
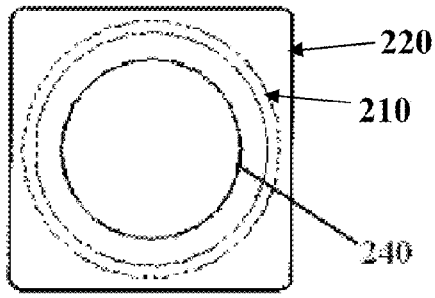
FIG. 2C is a cross-sectional view obtained along section C-C of the outer pipe shown in FIG. 2A in accordance with an embodiment of the present invention.

For the purpose of illustration, an exemplary embodiment of the outer pipe 200 of the mold center is shown in FIGS. 2A-C. As shown in FIG. 2A, the outer pipe 200 includes an outer pipe body 210 which can be of any suitable size to achieve the desired inner diameter of the resulting hollow ingot. For example, the pipe can be between about 2 and 14 inches in diameter.

The outer pipe 200 can be made of any suitable material which is capable of withstanding the harsh conditions and high temperatures associated with the molten material, assuming adequate cooling. Further and more importantly, the outer pipe 200 must be capable of withstanding the pressure of contracting molten metal material, as radial pressures on the mold center can be about 1 to 2 ksi. Therefore, the material used for the mold center preferably has a minimum tensile yield strength of 30 ksi, a minimum tensile ultimate strength of 48 ksi, and a minimum thermal conductivity of 25 BTU/hr-ft-° F. The material should also be relatively easy to machine. Preferably, the outer pipe is made of steel, copper, other metallics, ceramics, or any other suitable materials. Additionally, a metallic material with a ceramic coating can be used. Exemplary coatings include zirconia, silica, yttrium oxide, and other suitable ceramic materials. In a preferred embodiment, the outer pipe is consumable and will remain with the resulting hollow ingot for further processing. Accordingly, the outer pipe should be made of an inexpensive and readily available material, which is still capable of withstanding the pressure of contracting molten material. An example of a suitable material is heavy duty pipe such as schedule 80 steel pipe.

As shown in FIG. 2A, a plate 220 can be welded to the bottom portion of the outer pipe body 210. Extending down from the plate 220 can be a square tube 230, as shown in FIG. 2A. FIG. 2B is a cross-sectional view obtained along line D-D in FIG. 2A whereas FIG. 2C is a cross-sectional view obtained along line C-C in FIG. 2A. As can be seen in FIG. 2C, the plate 220 includes circular opening 240 for receiving the inner pipe 300.

Figure 3A:
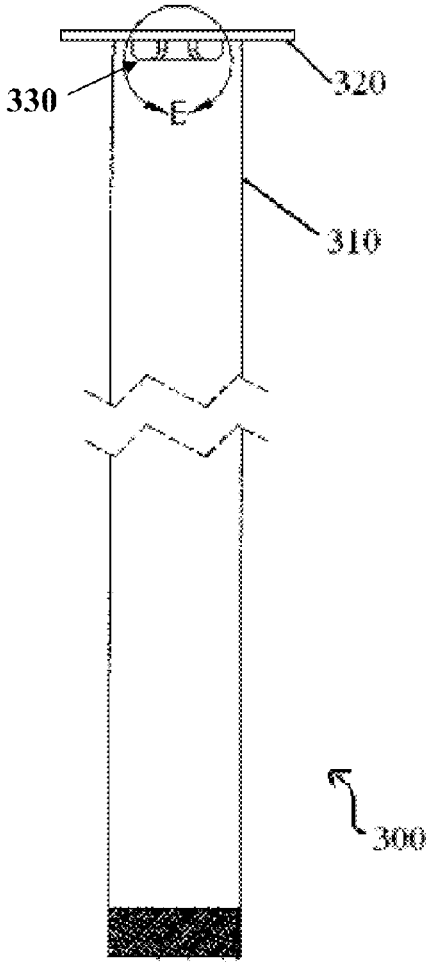
FIG. 3A is a side view of the inner pipe of the mold center in accordance with an embodiment of the present invention.
Figure 3B:
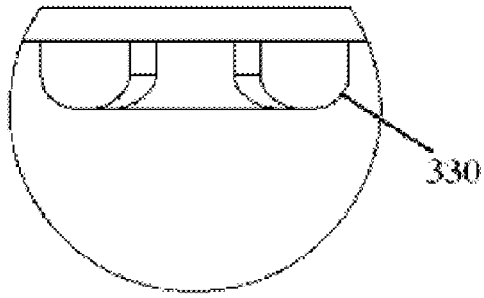
FIG. 3B is a close-up of section E of the inner pipe shown in FIG. 3A in accordance with an embodiment of the present invention.

For the purpose of illustration, and not limitation, an exemplary embodiment of the inner pipe 300 is provided in FIGS. 3A and 3B. The inner pipe body 310 shown in FIG. 3A should be sized such that it forms a suitable annular space between the inner pipe 300 and the outer pipe 200 (from FIG. 2) for the circulation of a cooling medium. For example, if the outer pipe 200 is about 10 inches in diameter, then the inner pipe 300 is preferably about 6 inches in diameter.

The inner pipe 300 can be made of any suitable material. For example, the inner pipe 300 can be made of steel, copper, other metallics, ceramics, or other suitable materials. In the exemplary embodiment where the outer pipe 200 (from FIG. 2) is consumable, the inner pipe 300 preferably can be removed from the outer pipe 200 after production of the hollow ingot and thus can be reused. Accordingly, the inner pipe 300 is not restricted to inexpensive and readily available materials. In a preferred embodiment, the inner pipe 300 is schedule 40 steel pipe.

As further shown in FIG. 3A, in the exemplary embodiment, a jig 320, such as a ½ inch jig, is attached to the top of the inner pipe body 310. Attached to the jig 320 is a circulation means 330 for allowing the circulation of the cooling medium. A close-up of the circulation means 330 is provided in FIG. 3B. The circulation means 330 can be any suitable arrangement such as, for example holes or passages. However, the circulation means 330 should be selected to provide enough cross sectional area to provide a sufficient flow rate of the cooling medium through the circulation means 330 without restriction.

Figure 4A:
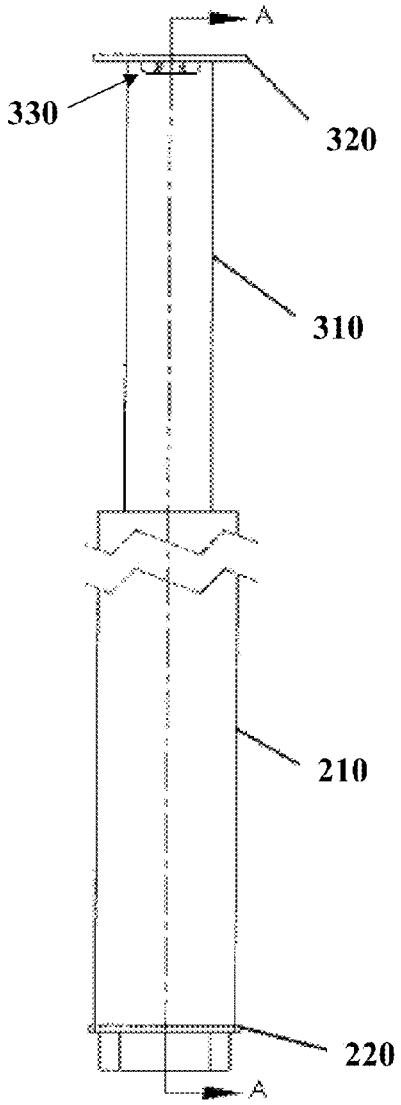
FIG. 4A is a side view of the inner pipe inserted into the outer pipe of the mold center in accordance with an embodiment of the present invention.
Figure 4B:
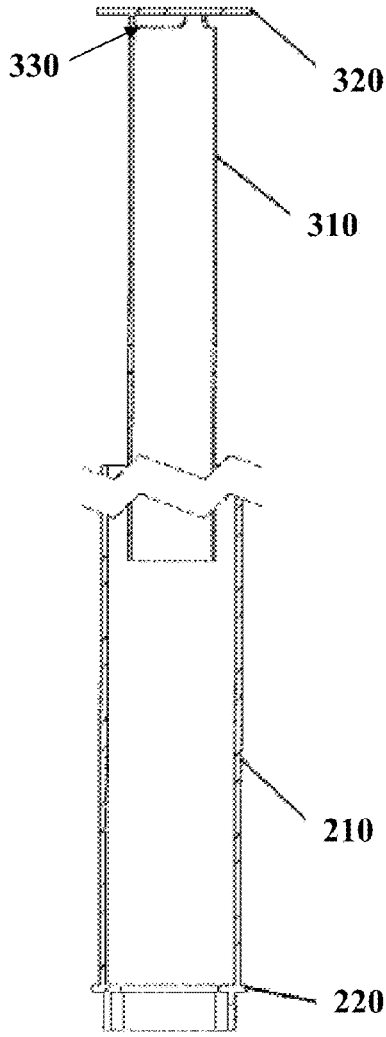
FIG. 4B is a cross-sectional view obtained along section A-A of the inner pipe inserted into the outer pipe shown in FIG. 4A in accordance with an embodiment of the present invention.
Figure 5A:
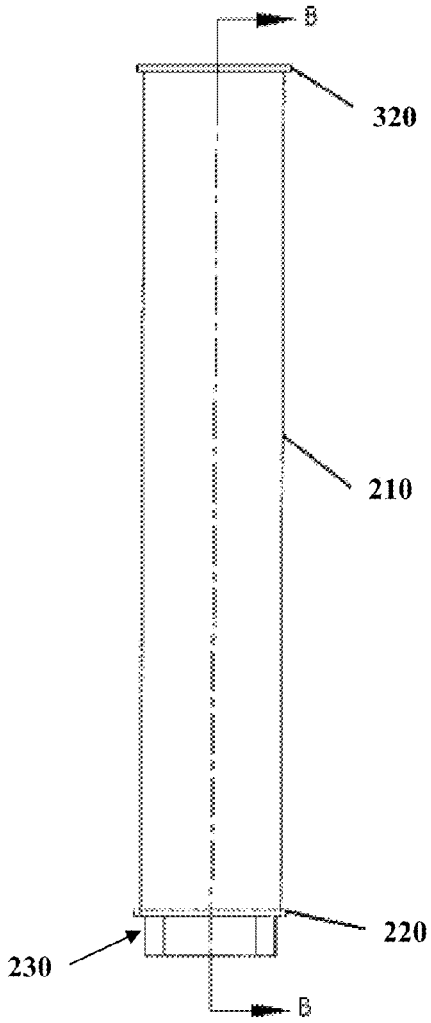
FIG. 5A is a side view of the inner pipe locked into the outer pipe of the mold center in accordance with an embodiment of the present invention.
Figure 5B:
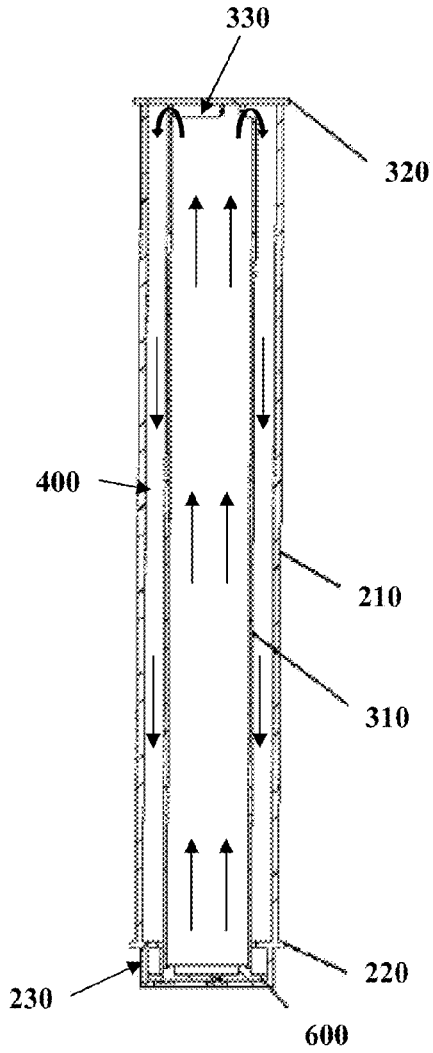
FIG. 5B is a cross-sectional view obtained along section B-B of FIG. 5A which shows the inner pipe locked into the outer pipe in accordance with an embodiment of the present invention.
Figure 6A:
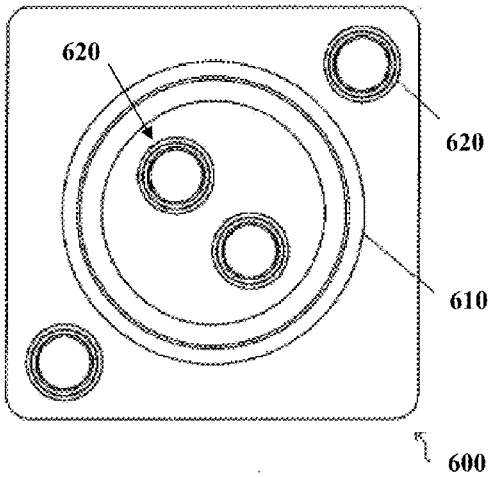
FIG. 6A is a top view of a plate in accordance with an embodiment of the present invention.
Figure 6B:
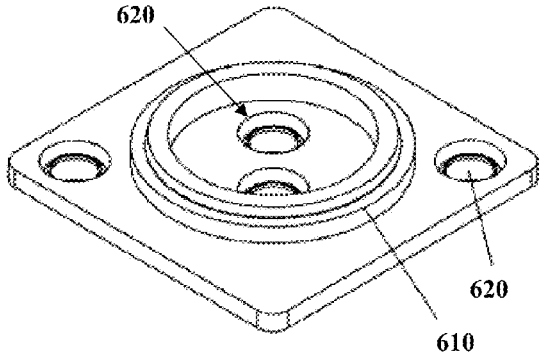
FIG. 6B is a perspective view of the plate shown in FIG. 6A in accordance with an embodiment of the present invention.
Figure 6C:
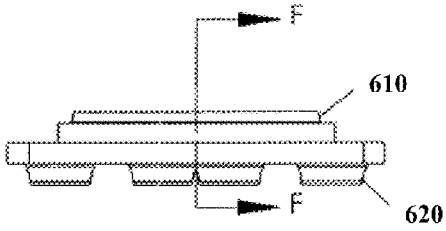
FIG. 6C is a side view of the plate shown in FIG. 6A in accordance with an embodiment of the present invention.
Figure 6D:
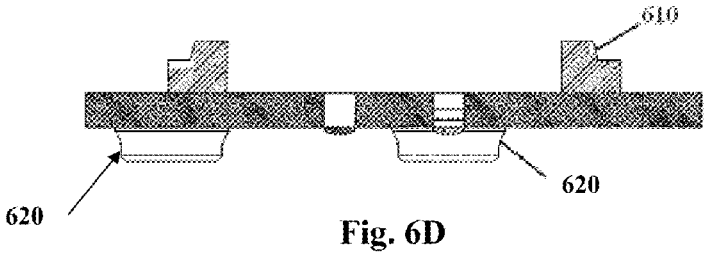
FIG. 6D is a cross-sectional view obtained along section F-F of the plate shown in FIG. 6C in accordance with an embodiment of the present invention.

In practice, inner pipe 300 (from FIG. 3A) is inserted into outer pipe 200 (from FIG. 2A), as is shown in FIGS. 4A and 4B. Once inner pipe body 310 is inserted fully into outer pipe body 210, as shown in FIGS. 5A and 5B, plate 600, as shown in FIG. 5B, is inserted at the bottom to secure the inner pipe 300 (from FIG. 3A) relative to the outer pipe 200 (from FIG. 2A) and create an air-tight seal. The arrangement of the inner pipe body 310 and outer pipe body 210 creates an annular space 400. In a preferred embodiment, internal welds are used to secure plate 600 in order to avoid interference problems with placing the center mold in the puller, which will be described in more detail below.

For the purpose of illustration, and not limitation, an exemplary plate 600 is shown in FIGS. 6A-D. The top of plate 600 can include a support ring 610 that is arranged to receive the bottom of inner pipe body 310 (from FIG. 3A) and form a air-tight seal. Holes 620 can be included in the plate 600 to allow for the flow of the cooling medium into and out of the inner pipe 300 (from FIG. 3A) and the annular space 400 between the inner 300 and outer 200 pipes as shown in FIG. 5B. While exemplary plate 600 is square, other shapes of plates can be used.

Returning now to FIG. 1, the method continues with circulating a cooling medium in the annular space in step 120. The cooling medium inlet and outlet can be provided at substantially the base of the mold. In a preferred embodiment, cooling medium lines attach to plate 600 through holes 620, shown in FIG. 6A. In a preferred embodiment, the cooling medium flows up through the inner pipe body 310, out through the circulation means 330, and then down through the annular space 400 as shown, for example, in FIG. 5B. This arrangement allows for colder water, and therefore superior cooling, to be present at the top of the mold which is where the liquid pool meniscus forms. This arrangement also has the added benefit of providing additional cooling to the outer pipe 200 (from FIG. 2A) exposed to radiation from the surface of the liquid pool and any incidental electron beams or other heating device that may contact the pipe. Alternatively, the cooling medium can flow up through the annular space 400, through the circulation means 330, and then down through the inner pipe body 310 (in the opposite direction to that shown in FIG. 5B). This arrangement helps prevent the collection of steam at the top of the mold center.

The cooling medium should be selected to provide suitable cooling of the outer pipe 200 (from FIG. 2A), which in turn cools the molten material. Exemplary cooling medium include water, sodium-potassium eutectic, and other suitable medium. Preferably the cooling medium is water. The cooling medium should be provided at a low enough temperature to achieve the desired cooling of the molten material and to dissipate any heat associated with incidental contact of the electron beam with the outer pipe. For example, providing water at about 60° F. will provide adequate cooling. The flow rate of the medium should be selected to provide suitable cooling and will depend on the cooling medium used. For example, if the cooling medium is water, a preferred flow rate is between about 45 and 100 gallons per minute.

Returning now to FIG. 1, the method continues with step 130 in which a source material is fed into the mold. In a preferred embodiment, the source material is fed at substantially the top of the mold. Preparation of the blend for feeding is selected to meet the desired properties and composition of the resulting hollow ingot. In a preferred embodiment the source material is a metal or metal alloy. The source material can be, for example, titanium, zirconium, niobium, tantalum, hafnium, nickel, other reactive metals, and alloys thereof. In an exemplary embodiment, the flow rate of the source material is between about 100 and 3000 pounds per hour and will depend on the density of the source material used and the desired diameter of the cast hollow ingot.

Returning now to FIG. 1, the method continues with step 140 in which the source material is heated to form a molten material. In an exemplary embodiment, the molten material is melted using one or more electron beam guns (as shown as 850 in FIG. 8). Any number and arrangement of electron beam guns 850 can be used as long as enough heat is provided to maintain molten material across the entire surface of the liquid pool. For example, four electron beam guns 850 spaced about 90° apart around the circumference of the outer mold can provide adequate coverage of the liquid pool surface. Appropriate electron beam gun powers used will depend on the flow rate and density of the source material, the number of guns used, the gun arrangement, and the gun manufacturer. For example, gun powers of 50-800 kW can be used. The beam pattern on the mold surface should be adjusted to ensure that the entire top surface remains liquid, thereby producing a desired surface on both the inner and outer diameter of the tubular preform. However, beam pattern adjustment must be balanced against the risk of having an electron beam too close to the inner pipe 300 (from FIG. 3A), as getting this too hot could lead to a catastrophic rupture in the pipe or the formation of, for example, an iron-titanium eutectic at the interface between the pipe and the molten material. Alternatively, an electroslag remelting process can be used to melt the source metal material, as is known in the art.

Returning now to FIG. 1, the method continues with step 150 in which the mold center is moved progressively downward relative to the outer mold. In a preferred embodiment, the mold center is moved downward at substantially the same rate at which the source material is added such that the location of the liquid pool stays about the same.

Figure 7A:
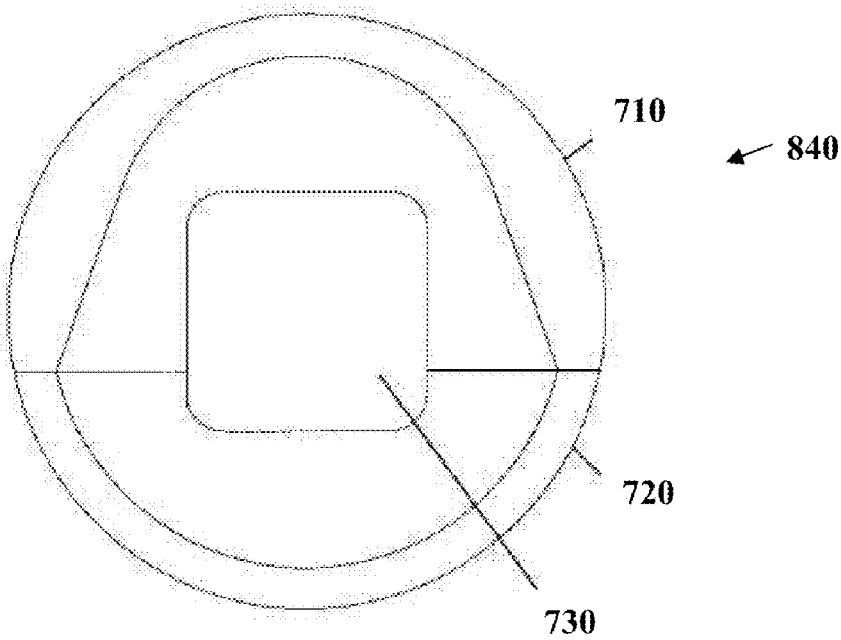
FIG. 7A is a top view of a puller in accordance with an embodiment of the present invention.
Figure 7B:
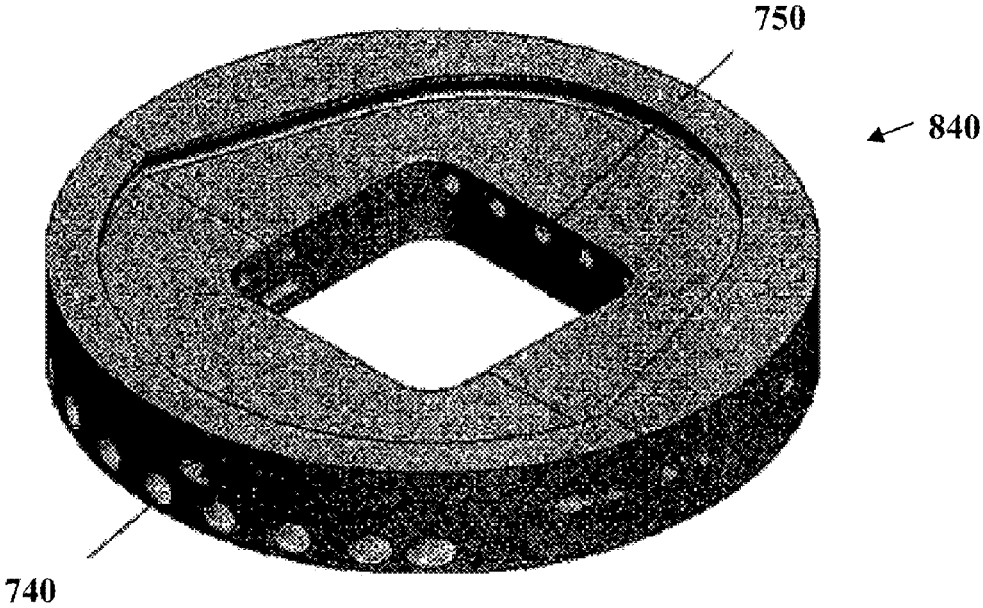
FIG. 7B is a perspective view of the puller shown in FIG. 7A in accordance with an embodiment of the present invention.
Figure 8:
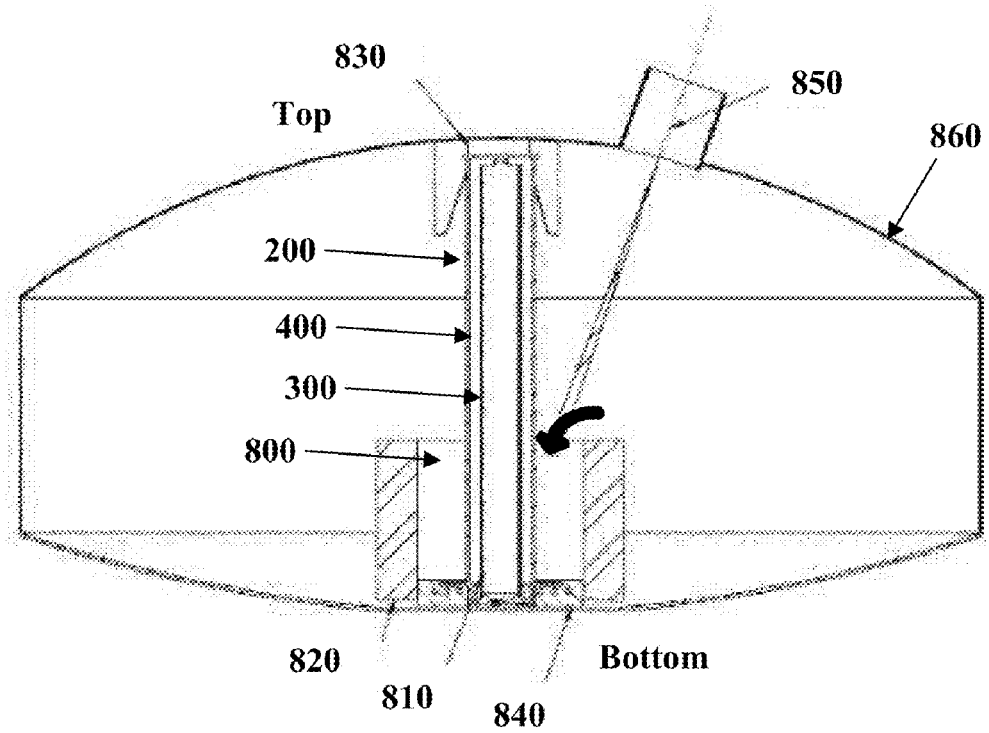
FIG. 8 is a cross-sectional side view of a furnace in accordance with an embodiment of the present invention.

For the purpose of illustration and not limitation, and as shown in FIG. 7A and FIG. 7B, a puller 840 is provided. The puller 840 can be used to move the mold center through the mold in a downward direction (as shown in FIG. 8). In an exemplary embodiment, a device is used to pull the puller down. For example, and without limitation, the device may be a hydraulic cylinder which collapses. Additionally, the puller 840 can be used to lock the mold center in place. In practice, square tube 230 (see FIGS. 2A-B) attached to the bottom of the outer pipe body 210 (from FIGS. 2A-B) is placed into the hole 730 in the center of the puller 840. Two portions of the puller, a first portion 710 and a second portion 720 are then secured tightly together around square tube 230 using bolts in bolt holes 740 provided in the puller 840, as shown in FIG.

7B. Additionally, the puller 840 can include water passages 750 to internally cool the puller 840 itself. In one exemplary embodiment, the puller 840 is ground or machined to create cooling medium lines, not shown, for feeding and withdrawing the cooling medium to and from the mold center.

Returning now to FIG. 1, the method continues with solidifying the molten material to form the hollow ingot in step 160. In an exemplary embodiment, the molten material solidifies as a result of cooling from both the water cooled mold center 810 and the water cooled outer mold 820, as shown in FIG. 8 which is a schematic showing a typical furnace 860. The type of furnace used may be, for example, a vacuum furnace, electroslag furnace, or plasma arc furnace, or any type of furnace which is well-known in the art. FIG. 8 clearly shows the configuration of the mold center 810 relative to the outer mold 820 to form a mold cavity 800 in-between. The manner in which the mold arrangement interfaces with the furnace is also readily apparent to those knowledgeable in the art.

In some embodiments, a receiver 830, as shown in FIG. 8, is provided for holding the mold center 810 to prevent lateral movement of the mold center 810 during casting. In an exemplary embodiment, the receiver 830 includes three plates which attach to the top of the mold center 810 to keep the mold center 810 concentric throughout the casting process. Use of a receiver 830 prevents out of center internal holes and increases the resulting yield of the hollow ingot.

Figure 9A:
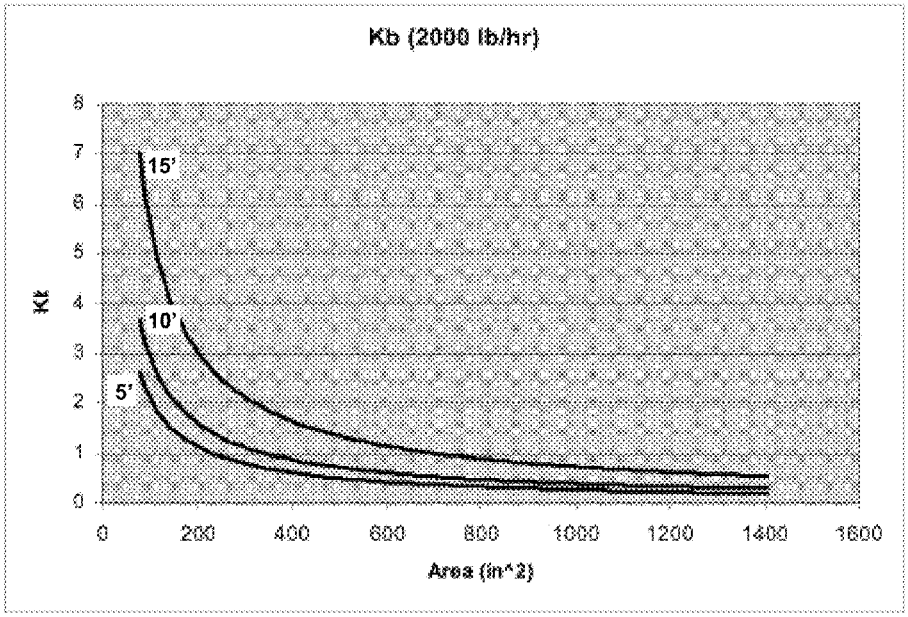
FIG. 9A is a plot showing the value of the length correction factor $k_b$ as a function of the cross-sectional area $A_{x\text{-}sect}$ of a hollow ingot at a casting rate $R_{cast}$ of 2,000 lb/h for ingot lengths $L_{ingot}$ of 15, 10, and 5 feet.
Figure 9B:
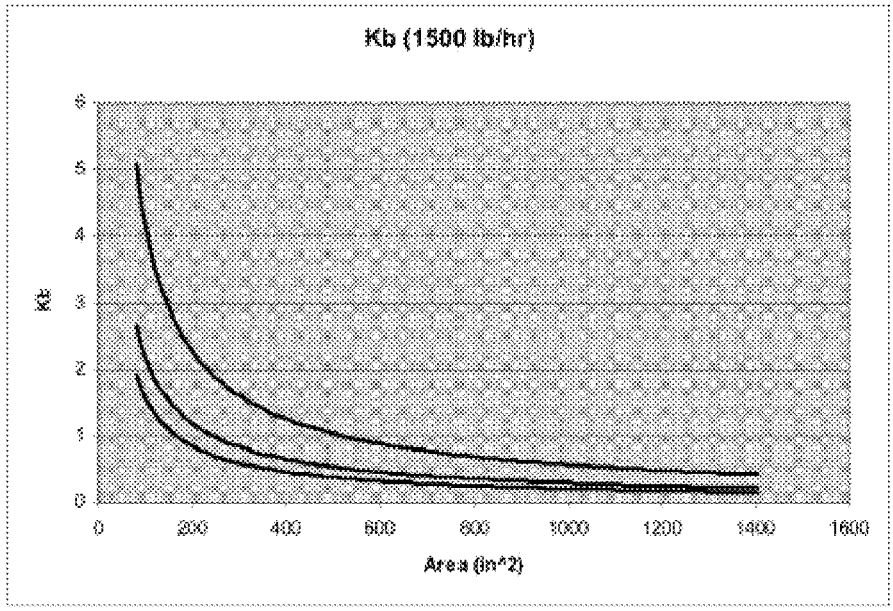
FIG. 9B is a plot showing the value of the length correction factor $k_b$ as a function of the cross-sectional area $A_{x\text{-}sect}$ of a hollow ingot at a casting rate $R_{cast}$ of 1,500 lb/h for ingot lengths $L_{ingot}$ of 15, 10, and 5 feet.
Figure 9C:
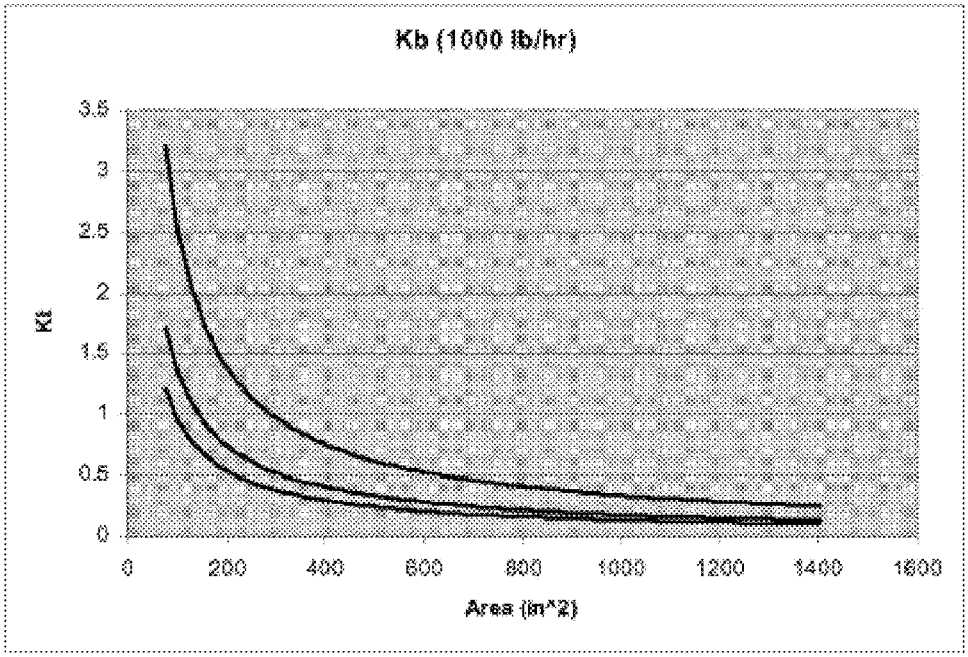
FIG. 9C is a plot showing the value of the length correction factor $k_b$ as a function of the cross-sectional area $A_{x\text{-}sect}$ of a hollow ingot at a casting rate $R_{cast}$ of 1,000 lb/h for ingot lengths $L_{ingot}$ of 15, 10, and 5 feet.

The method can further include cooling the ingot in the furnace 860 either under vacuum or at atmospheric pressures, depending on the material constituting the ingot. Resulting ingots prepared in accordance with the present invention are significantly cooler after the melt than standard ingots of the same diameter upon removal from the furnace. Thus, one advantage of the disclosed invention is a significant reduction in the time required to cool the ingot after melting. The reduction in cooling time is due in part to the outer pipe 200 of the mold center 810 being intimately connected to the cast material. In addition, the material is cooled from both the mold center 810 and the outer mold 820. Cooling times will depend on the desired diameter of the hollow ingot, and can be conservatively approximated using the following empirical formula:

$$t_{cooling}=A_{x\text{-}sect}(1/R_{cast})L_{ingot}\rho k_a k_b$$

where $t_{cooling}$ is the required cooling time (hr), $A_{x\text{-}sect}$ is the cross sectional area ($in^2$) of the hollow ingot, $R_{cast}$ is the casting rate (lb/hr), $L_{ingot}$ is the length of the cast hollow ingot (in), ρ is the material density ($lb/in^3$), $k_a$ is a correction factor which equals 0.52, and $k_b$ is a length correction factor. Values for $k_b$ may be obtained from FIGS. 9A, 9B, and 9C which are plots of $k_b$ as a function of the cross-sectional area $A_{x\text{-}sect}$ of a hollow ingot at casting rates $R_{cast}$ of 2,000 lb/h, 1,500 lb/h, and 1,000 lb/h, respectively. The top, middle, and bottom curves provided in FIGS. 9A-C represent ingot lengths $L_{ingot}$ of 15, 10, and 5 feet, respectively.

In another exemplary embodiment, the present invention provides an apparatus for semi-continuous casting of a hollow ingot. The apparatus includes a mold center 810 (from FIG. 8) having an inner pipe 300 and an outer pipe 200 arranged to form an annular space 400 for a cooling medium, an outer mold 820, and a puller 840 for moving the mold center 810 downward. A mold cavity 800 for receiving source material is provided between the mold center 810 and outer mold 820.

The inner 300 and outer 200 pipe can have any of the properties mentioned previously herein. For example, and as described above in more detail, in some embodiments, the outer pipe 200 is consumable and can remain with the ingot until further processing. The puller 840 can include a hole arranged to receive the mold center 810, and the puller 840 can lock the mold center 810 in place. The apparatus can include one or more electron beam guns 850. In alternate embodiments the source material can be heated by electroslag remelting, plasma arc processes, or using a plasma torch. In a preferred embodiment, the source material is added at the top of the mold cavity 800 near the location where it is heated as shown, for example, by the thick black arrow provided in FIG. 8. The puller 840 and electronic beam guns 850 can have any of the properties and/or arrangements mentioned previously herein.

In another exemplary embodiment, the present invention provides a metallic hollow ingot product. The metallic hollow ingot product includes a metallic hollow ingot and a pipe intimately connected to the metallic hollow ingot at the inner surface of the metallic hollow ingot.

The hollow ingot and pipe can have any of the properties mentioned previously herein. For example, the pipe can made of steel, copper, other metallics, ceramics, or other suitable materials. The hollow ingot can be produced from materials selected from the group consisting of titanium, zirconium, niobium, tantalum, hafnium, nickel, other reactive metals, and alloys thereof. In a preferred embodiment the hollow ingot is cast using a metal or metallic material and is therefore a hollow metallic ingot.

The disclosed invention is suitable for preparing samples of a wide variety of sizes. For purpose of illustration, and without limitation, example sizes of hollow ingots produced from a metallic material are provided in the table below:

| Sample No. | Outside Diameter (in.) | Inside Diameter (in.) | Length (in.) |
|---|---|---|---|
| 1. | >18 | <8.5 | >55 |
| 2. | >23 | <10.75 | >65 |
| 3. | >25 | <13.375 | >70 |

Process parameters that can be varied include the type of source material, the rate at which source material is supplied, the amount of heat applied through the heating source, the cooling rate arising from supplying cooling medium to the central core and outer casting mold, the rate at which the central core is pulled downwards, as well as the overall dimensions of the mold itself.

EXAMPLE 1

A titanium alloy was formulated to produce a molten metal material with modifications to produce an Extra Low Interstitials ("ELI") material for increased toughness. A target casting rate of between 1000 and 3000 lb/hr was used.

The ingot was melted using electronic beam guns. Observation through a viewport glass present on the furnace clearly indicated that the entire liquid surface that was visible was fully molten.

No leaks developed and no weld failure occurred during the melt. The mold center cooling circuit reached 90° F. maximum and averaged about 85° F.

The top surface of the ingot was fairly flat and uniform. In general, the surface condition was fairly reasonable.

Sample slices were cut from the ingot. The cross sections showed a small diametrical change of the mold center outer shell.

While the present invention is described herein in terms of certain preferred embodiments and examples, those skilled in the art will recognize that various modifications and improvements may be made to the invention without departing from the scope thereof. Thus, it is intended that the present invention include modifications and variations that are within the scope of the appended claims and their equivalents. Moreover, although individual features of one embodiment of the invention may be discussed herein or shown in the drawings of one embodiment and not in other embodiments, it should be apparent that individual features of one embodiment may be combined with one or more features of another embodiment or features from a plurality of embodiments.

In addition to the specific embodiments claimed below, the invention is also directed to other embodiments having any other possible combination of the dependent features claimed below and those disclosed above. As such, the particular features presented in the dependent claims and disclosed above can be combined with each other in other manners within the scope of the invention such that the invention should be recognized as also specifically directed to other embodiments having any other possible combinations. Thus, the foregoing description of specific embodiments of the invention has been presented for purposes of illustration and description. It is not intended to be exhaustive or to limit the invention to those embodiments disclosed.

It will be appreciated by persons skilled in the art that the present invention is not limited to what has been particularly shown and described in this specification. Rather, the scope of the present invention is defined by the claims which follow. It should further be understood that the above description is only representative of illustrative examples of embodiments. For the reader's convenience, the above description has focused on a representative sample of possible embodiments, a sample that teaches the principles of the present invention. Other embodiments may result from a different combination of portions of different embodiments.

The description has not attempted to exhaustively enumerate all possible variations. The alternate embodiments may not have been presented for a specific portion of the invention, and may result from a different combination of described portions, or that other undescribed alternate embodiments may be available for a portion, is not to be considered a disclaimer of those alternate embodiments. It will be appreciated that many of those undescribed embodiments are within the literal scope of the following claims, and others are equivalent. Furthermore, all references, publications, U.S. patents, and U.S. patent application Publications cited throughout this specification are incorporated by reference as if fully set forth in this specification.

What is claimed is:

1. A method for semi-continuously casting hollow ingots comprising:

providing a mold having a mold cavity formed between:

a mold center having an inner pipe and an outer pipe arranged to form an annular space for a cooling medium; and an outer mold;

circulating a cooling medium in the annular space;

feeding a source material into the mold cavity;

heating the source material to produce a molten material;

moving the mold center progressively downward relative to the outer mold; and solidifying the molten material to form the hollow ingot.

2. The method of claim 1, wherein the mold center is moved progressively downward using a puller.

3. The method of claim 1, wherein the cooling medium is provided at substantially the base of the mold and the cooling medium flows up through the inner pipe and down through the annular space.

4. The method of claim 1, wherein the cooling medium is water or a sodium-potassium eutectic.

5. The method of claim 1, wherein the mold center is locked in place using a puller.

6. The method of claim 1, wherein the source material is heated by one or more electron beam guns, electroslag remelting, a plasma arc process, or one or more plasma torches.

7. The method of claim 1, wherein the outer pipe remains with the ingot after casting until further processing.

8. The method of claim 1, wherein the source material is selected from the group consisting of titanium, zirconium, niobium, tantalum, hafnium, nickel, and alloys thereof.

9. The method of claim 1, where in the outer pipe is selected from the group consisting of steel, copper, and ceramics.

10. The method of claim 1, wherein the source material is fed into the mold cavity at substantially the top of the mold.

11. The method of claim 1, further comprising providing a receiver holding the mold center to prevent lateral movement of the mold center during casting.

12. An apparatus for semi-continuous casting of hollow ingots comprising:

a mold center having an inner pipe and an outer pipe arranged to form an annular space for a cooling medium, the mold center being configured to move progressively downward through the apparatus during casting of the hollow ingot;

an outer mold which is configured to provide a mold cavity between the mold center and said outer mold;

a heating device configured to heat a top surface region of said mold cavity and a puller for moving the mold center downward relative to the outer mold.

13. The apparatus of claim 12, wherein the outer pipe is consumable and remains with the ingot until further processing.

14. The apparatus of claim 12, wherein the puller comprises a hole arranged to receive the mold center.

15. The apparatus of claim 12, wherein the puller locks the mold center in place.

16. The apparatus of claim 12, the heating device comprises one or more electron beam guns, an electroslag remelting apparatus, a plasma arc apparatus, or one or more plasma torches.

17. The apparatus of claim 12, further comprising a receiver located above the mold center and arranged to prevent lateral movement of the mold center during casting.

* * * * *